US009359816B2

(12) United States Patent
Lee

(10) Patent No.: US 9,359,816 B2
(45) Date of Patent: Jun. 7, 2016

(54) ROLLER SHUTTER

(71) Applicant: Rae young Lee, Chungcheongnam-do (KR)

(72) Inventor: Rae young Lee, Chungcheongnam-do (KR)

( * ) Notice: Subject to any disclaimer, the term of this patent is extended or adjusted under 35 U.S.C. 154(b) by 12 days.

(21) Appl. No.: 14/404,622

(22) PCT Filed: May 28, 2013

(86) PCT No.: PCT/KR2013/004670

§ 371 (c)(1),
(2) Date: Nov. 30, 2014

(87) PCT Pub. No.: WO2013/180445

PCT Pub. Date: Dec. 5, 2013

(65) Prior Publication Data

US 2015/0144276 A1 May 28, 2015

(30) Foreign Application Priority Data

May 30, 2012 (KR) ..... 10-2012-0057382

(51) Int. Cl.
*E06B 9/15* (2006.01)
*E06B 9/42* (2006.01)
(Continued)

(52) U.S. Cl.
CPC ... *E06B 9/42* (2013.01); *E06B 9/15* (2013.01); *E06B 9/171* (2013.01); *E06B 9/581* (2013.01); *E06B 9/70* (2013.01); *E06B 2009/1527* (2013.01); *E06B 2009/1544* (2013.01)

(58) Field of Classification Search
CPC ..... E06B 2009/1554; E06B 2009/1505
USPC ..... 160/232, 235, 236; 49/92.1; 16/386
See application file for complete search history.

(56) References Cited

U.S. PATENT DOCUMENTS 3,359,594 A * 12/1967 Pastoor ..... E06B 3/481 16/356

(Continued)

FOREIGN PATENT DOCUMENTS

JP 2000-145324 5/2000
JP 4685056 2/2011

(Continued)

OTHER PUBLICATIONS

International Search Report Dated Jul. 15, 2013 From the Korean Intellectual Property Office Re. Application No. PCT/KR2013/004670 and Its Translation Into English.

(Continued)

*Primary Examiner* — David Purol

(57) ABSTRACT

The present invention relates to a roller shutter in which a slat connection structure is very flexible so as to reduce manufacturing and maintenance costs. The roller shutter of the present invention comprises: a plurality of slats continuously connected in the vertical direction; a winding unit for winding or unwinding the plurality of slats in the vertical direction; a shutter box arranged above a door frame of a building; and a guide frame for guiding the edges of the plurality of slats. The winding unit is arranged inside the shutter box. The plurality of slats are connected in the vertical direction such that the slats can be pivoted. One end of each slat has a hook, and the hook is curved with a predetermined radius of curvature. The other end of each slat has an accommodation groove curved at a predetermined radius of curvature. The hook of one slat is accommodated in the accommodation groove of another slat adjacent to said slat such that the hook is movable in the circumferential direction, thus enabling said slat and the other slat adjacent thereto in the vertical direction to pivot relative to one another. The hook has an inner surface and an outer surface. The accommodation groove has a first inner surface, a second inner surface, a closed surface, and an opening. The radius of the second inner surface of the accommodation groove is larger than that of the first inner surface. The first inner surface extends in the circumferential direction so as to form a cylinder. The inner surface of the hook and the first inner surface of the accommodation groove have the same radius, and the outer surface of the hook and the second inner surface of the accommodation groove have the same radius.

15 Claims, 8 Drawing Sheets

(51) Int. Cl.

| | |
|---|---|
| ***E06B 9/171*** | (2006.01) |
| ***E06B 9/58*** | (2006.01) |
| ***E06B 9/70*** | (2006.01) |

(56) References Cited

U.S. PATENT DOCUMENTS 4,173,247 A * 11/1979 Piana ..... E06B 9/165 160/220
4,343,340 A * 8/1982 Paule ..... E06B 9/165 160/232
4,628,982 A * 12/1986 Labelle ..... E06B 9/15 160/232
4,644,724 A * 2/1987 Schijf ..... E04F 13/0889 160/235
4,846,247 A * 7/1989 Kessler ..... E06B 9/15 160/235
4,979,553 A 12/1990 Lowry, III et al.
5,419,386 A * 5/1995 Magro ..... E06B 9/15 160/232
6,513,862 B2 * 2/2003 Dodson ..... E06B 3/486 160/235

FOREIGN PATENT DOCUMENTS

KR 20-1998-0008478 4/1998
WO WO 2013/180445 12/2013

OTHER PUBLICATIONS

Written Opinion Dated Jul. 15, 2013 From the Korean Intellectual Property Office Re. Application No. PCT/KR2013/004670 and Its Translation Into English.

* cited by examiner

ROLLER SHUTTER

RELATED APPLICATIONS

This application is a National Phase of PCT Patent Application No. PCT/KR2013/004670 having International filing date of May 28, 2013, which claims the benefit of priority of Korean Patent Application No. 10-2012-0057382 filed on May 30, 2012. The contents of the above applications are all incorporated by reference as if fully set forth herein in their entirety.

TECHNICAL FIELD

The present invention relates to a roller shutter, and in particular to a roller shutter which is capable of reducing a manufacturing cost and a maintenance cost since a structure for connecting slats is very flexible.

BACKGROUND ART

In general, a roller shutter is designed to open or close a shutter in such a manner that a plurality of slats made from a narrow and longitudinal steel sheet or aluminum are continuously interconnected and wound on or unwound from a rotary shaft installed inside of a shutter box at the top of a door frame.

In a place such as a beach or a plain, a building wherein a shutter is installed might receive strong wind. At this time, the wind pressure resistance criteria of a typical slat is below 45 m/s. In case that a wind speed is over 45 m/s, the slat may be deformed by wind force, so the slat might be derailed from a guide rail, so the shutter might become impossible to be opened and closed.

Except for the above problem, when the shutter is deformed by means of an external impact, the shutter also might become impossible to be opened or closed.

Meanwhile, in case of the related roller shutter, when the slat is deformed by wind pressure or external impact, it needs to exchange the whole structure of a door unit of the shutter, which results in the increased exchanging cost and long repairing time.

Since the conventional roller shutter is formed in a complicated structure wherein many components are used, the manufacturing cost increases, and the productivity decreases.

DISCLOSURE OF INVENTION

Technical Problem

The present invention is made in an effort to improve the above mentioned problems. It is an object of the present invention to provide a roller shutter which makes it possible to easily exchange only some of the slats if some of the slats are deformed by wind pressure or external impact, and since a structure for interconnecting the slats is flexible, the manufacturing cost and maintenance cost may be saved.

Solution to Problem

To achieve the above object, there is provided a roller shutter, comprising:

a plurality of slats which are continuously connected in upward and downward directions;

a winding unit which is configured to wind or unwind the plurality of the slats in upward and downward directions;

a shutter box which is disposed at the top of a door frame of a building; and a guide frame which is configured to guide the edges of the plurality of the slat, wherein the winding unit is installed inside of the shutter box, and the plurality of the slats are pivotally connected in upward and downward directions, and a hook part is formed at an end of each slat, and the hook part is curved with a predetermined curvature radius, and an accommodation groove part is curved with a predetermined curvature radius at the other end of each slat, and the hook part of the slat of one side is movably accommodated in a circumferential direction in the accommodation groove part of the slat of the other side which is adjacent to the hook part of the slat of one side, and the slat of one side and the slat of the other side which are neighboring in the upward and downward directions perform a relative pivoting operation, and the hook part includes an inner surface and an outer surface, and the accommodation groove part includes a first inner surface, a second inner surface, a closed surface and an opening, and the second inner surface of the accommodation groove part has a radius larger than the first inner surface, and the first inner surface extends in a circumferential direction to form a cylindrical part, and the inner surface of the hook part and the first inner surface of the accommodation groove part have same radiuses, and the outer surface of the hook part and the second inner surface of the accommodation groove part have same radiuses.

A buffer material is disposed at each portion where the hook part and the accommodation groove part come into contact with each other.

The buffer material is installed at an inner surface and an end of the hook part, and the buffer material is installed at a closed surface of the accommodation groove part.

A hollow part having a circular cross section is formed inside of the cylindrical part, and the hollow part is formed at a portion eccentric from the center of the cylindrical part, so the cylindrical part has a thickness which is not uniform in a circumferential direction.

It is characterized that the cylindrical part gradually becomes thicker toward a closed surface of the accommodation groove part and gradually becomes thinner toward the opening of the accommodation groove part.

It is characterized that a reinforcing rib protrudes from a portion in proximity to the opening of the accommodation groove part of the slat.

It is characterized that a heating member is inserted inside of a hollow part of the cylindrical part.

It is characterized that a separation prevention member is installed between the slats which are connected in upward and downward directions, and the separation prevention member is secured to one slat between the slat of one side and the slat of the other side which are in proximity to each other in upper and lower sides. The separation prevention member includes an engaging part which is inserted in and engaged to the slat of one side, and a hooking part which extends from the engaging part to the slat of the other side.

It is characterized that the winding unit includes at least one first winding member and at least one second winding member which are symmetrically disposed at left and right sides, a first rotary shaft which protrudes from an outer side of the first winding member, a second rotary shaft which protrudes from an outer side of the second winding member, a plurality of horizontal support members which are connected crossing the first winding member and the second winding member, and a driving motor which is connected through a coupler to at least one rotary shaft between the first and second rotary shafts, and each of the first winding member and the second winding member is formed in a polygonal structure, and includes an insertion protrusion into which a hook part of the slat of the upper most side of one side surface is pivotally inserted, and the first and second rotary shafts are rotatably supported in the shutter box.

A slot is horizontally formed at one side surface of the shutter box which is neighboring with the driving motor, and an output shaft of the driving motor passes through the slot and is connected through the coupler to one rotary shaft between the first and second rotary shafts, and a shock absorber is installed in proximity to the slot of the shutter box, and a piston rod of the shock absorber buffers and supports the bottom of the coupler.

A support member is installed at a bracket which is attached to a decelerator drivingly connected to the driving motor, and a rotary shaft is installed at one side, and a support roller is installed at the top thereof, and the first and second rotary shafts and a driving device are balanced based on the movement along the lower surface of the guide rail.

At least one hook protrusion is formed at a side surface of each of the first winder member and the second winder member, and at least one hook groove is formed at a side surface of each of the slats, and in case that the slats are wound on the first and second winder members, the groove part of the slat is hooked by the hook protrusion of each of the first and second winder members, so the plurality of the slats are precisely mounted at the first and second winder members.

A buffer material is attached to a part of a side surface of each of the first and second winder members.

A pair of guide frames extending in upward and downward directions are disposed at lower left and right sides of the shutter box, and the left and right edges of the slats are guided and supported in upward and downward directions by the guide frames, and an opening is formed at one side of the guide frame, and a seal member is disposed at the opening, and a hollow part is formed in the guide frame, and the hollow part is partitioned by a reinforcing partition wall into a guide hollow part and a reinforcing hollow part, and an edge of each of the slats is inserted and guided in the guide hollow part, and a protection member is secured to the edge of the slat inserted in the guide hollow part.

The guide frame includes a first frame and a second frame, and a first engaging and attaching part is formed at one side of the first frame, and a second engaging and attaching part is formed at one side of the second frame, and the first and second engaging and attaching parts each are engaged through a hook structure, and a key is inserted between the first engaging and attaching part and the second engaging and attaching part.

A hollow part is formed inside of the slat, and a filler such as a heat insulation material, a soundproof material, an incombustible material, etc. is filled in the hollow part for thereby reinforcing heat insulation, cold reserving, fireproof, soundproof functions.

Advantageous Effects

The present invention has advantages wherein the flexibility as a whole is good thanks to the structure wherein a plurality of slats are pivotally interconnected. When such slats are wound on a winding unit, the wound diameter may be greatly reduced, so the entire length of the shutter may be increased, and each slat includes a hollow part, so that the slats become lighter, and the pulling force may be greatly reduced, thus saving the consumption of electric power.

The present invention has advantages wherein the inner surface of the hook part and the first inner surface of the accommodation groove part have same radiuses, and the outer surface of the hook part and the second inner surface of the accommodation groove part have same radiuses, so the hook part of the slat of one side provides a smooth pivoting operation while maintaining an airtight sealing inside of the accommodation groove part of the slat of the other side. In addition, the pivoting operation may be performed in a smooth sliding manner without using any lubricant, which results in a silent opening or closing operation without generating any noises.

In the present invention, a buffer material is disposed at each portion where the hook part and the accommodation groove part come into contact with each other, so that it is possible to buffer the impacts when the hook part and the accommodation groove part contact with each other while the interconnected slats pivot.

In addition, the present invention has advantages wherein the cylindrical part of the slat has a non-uniform thickness in a circumferential direction, so it is possible to obtain an increased resisting force against any impacts when the end of the hook part comes into contact with the closed surface of the accommodation groove part while the interconnected slats pivot, while preventing any noises which might occur due to the impacts.

BEST MODES FOR CARRYING OUT THE INVENTION

Figure 1:
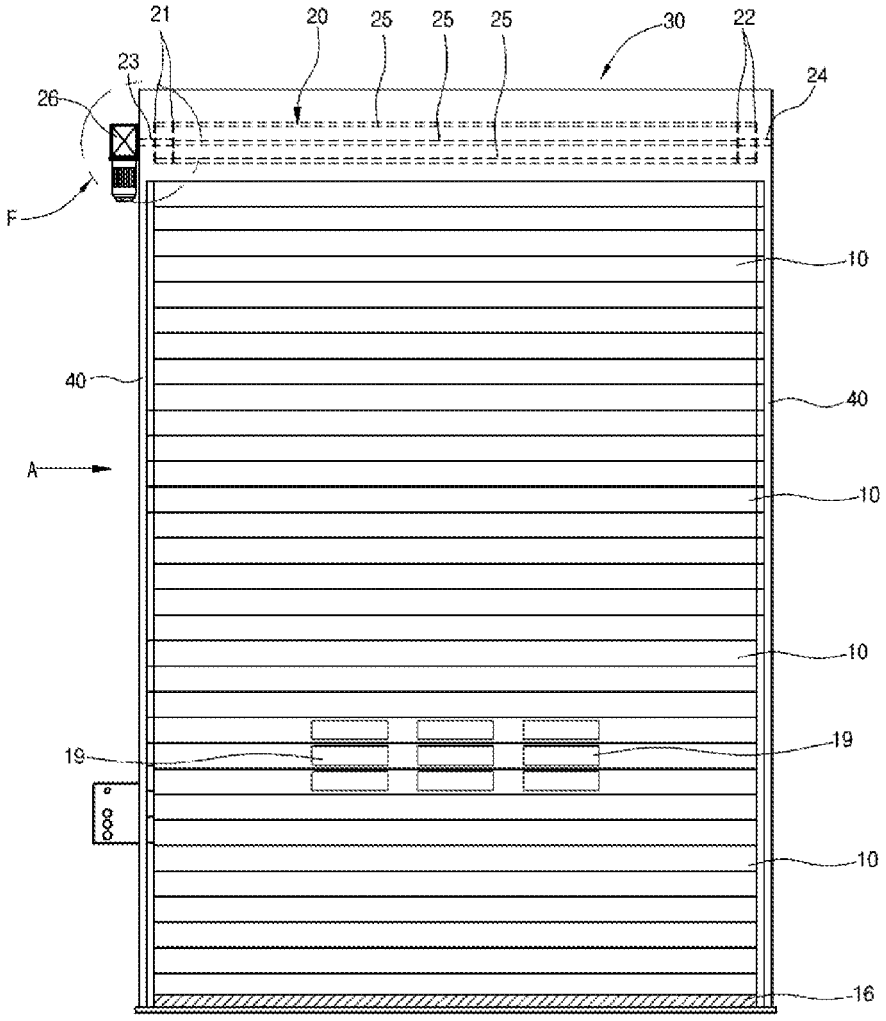
FIG. 1 is a front view illustrating a roller shutter according to an exemplary embodiment of the present invention.

The exemplary embodiment of the present invention will be described with reference to the accompanying drawings. For reference, the dimensions of the components and the thicknesses of the lines in the drawings might be exaggerated for the sake of easier understanding. The terms used throughout the descriptions of the present invention are defined in consideration of the functions of the present invention, so they may differ in accordance with the user, the operator's intention, practice, etc. Therefore, any definitions on such terms should be interpreted based on the contents throughout the present specification.

FIGS. 1 to 10 are views illustrating a roller shutter according to the present invention.

As illustrated therein, the roller shutter according to the present invention includes a plurality of slats 10 which are continuously connected in upward and downward directions, a winding unit 20 which is configured to wind or unwind the plurality of the slats 10 in the upward or downward direction, a shutter box 30 disposed at the top of a door frame of a building, and a guide frame 40 which is configured to guide the edges of the plurality of the slats 10.

Figure 2:
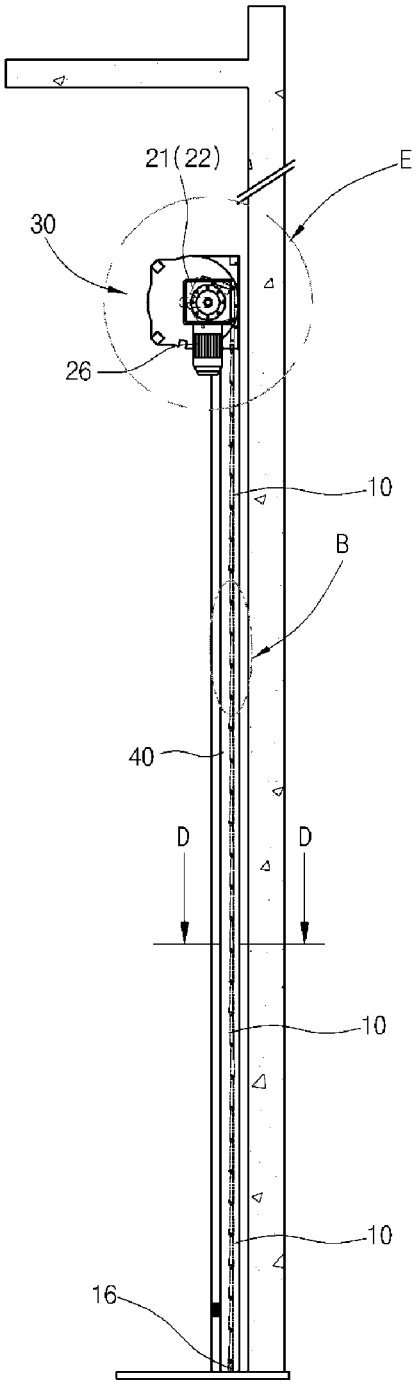
FIG. 2 is a side view when viewing from the direction of the arrow indication "A" in FIG. 1.
Figure 4:
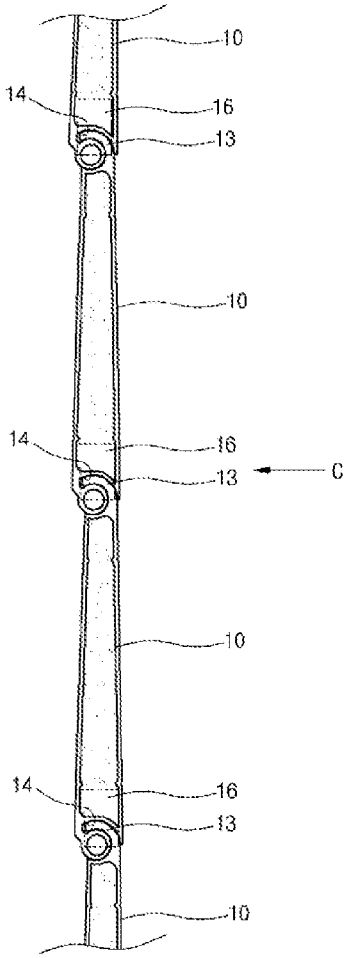
FIG. 4 is an enlarged view of the portion of the arrow indication "B" in FIG. 2.

Each of the slats 10 is formed in a structure whose height is low and width is long. The plurality of the slats 10, as illustrated in FIGS. 1, 2 and 4, are pivotally interconnected in upward and downward directions, and the opening of the building may be opened or closed as the plurality of the slats 10 are wound on or unwound from the winding unit 20.

A transparent window 19 is disposed at some of the slats 10 of the lower side among the plurality of the slats 10 so as to visually check the inner space of the building. In addition, a windproof material 16 is attached to the slat 10 of the lower most side. When the plurality of the slats 10 are closed, the windproof material 16 limits the input and output of the air through a gap spaced from the bottom surface, thus enhancing sealing performance and blocking any noises thanks to the sealing between the indoor space and the outdoor space.

A hollow part 11 is formed inside of the slat 10. A filler 12 such as a heat insulation material, a soundproof material, etc. is filled in the hollow part 11, so it is possible to enhance the effects such as heat insulation, cold reserving, fireproof, sound blocking, etc. The filler 12 made of a heat insulation material, a soundproof material, an incombustible material, etc. may be filled in the hollow part 11 of the slat 10, so the heat insulation, cold reserving, fireproof and soundproof functions can be enhanced.

Figure 3:
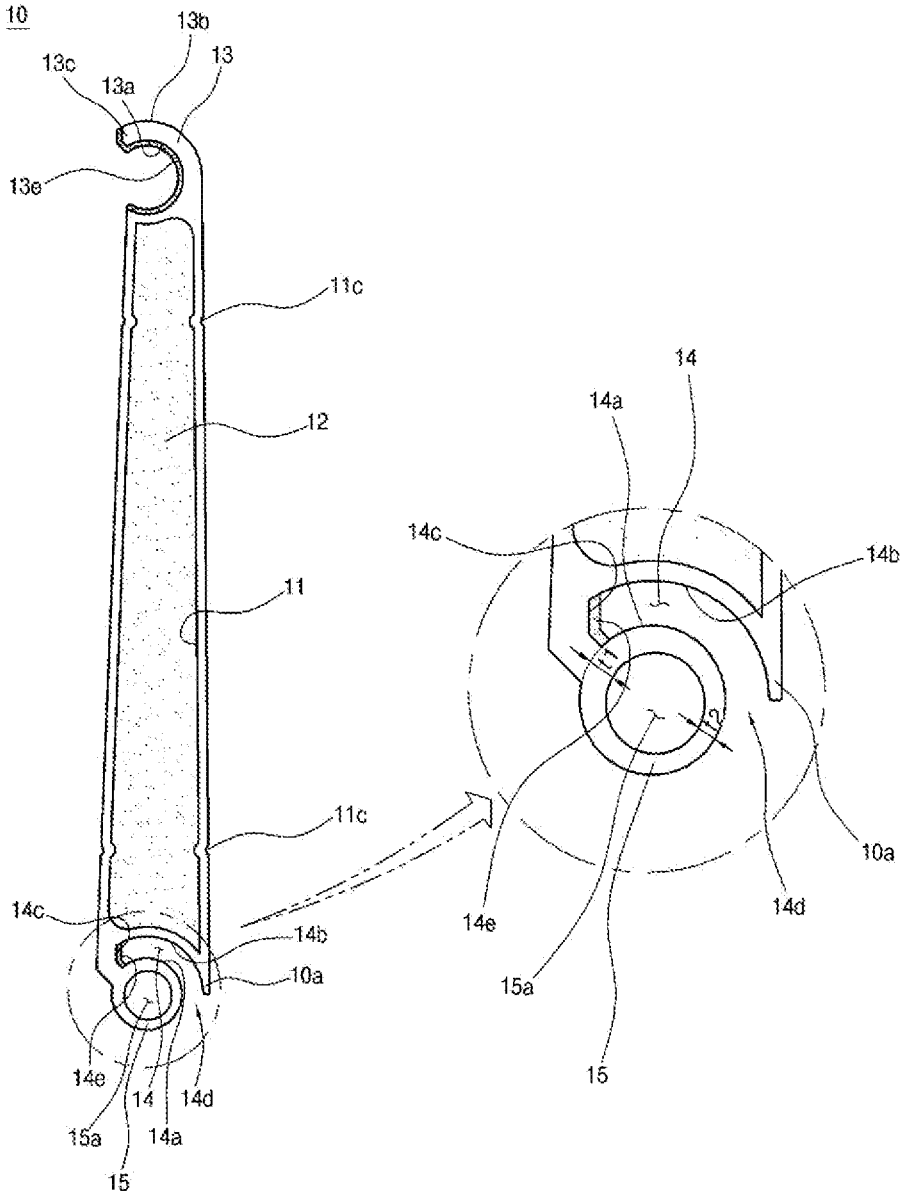
FIG. 3 is a side view illustrating a slat of a roller shutter according to the present invention.

As illustrated in FIG. 3, a hook part 13 is formed at an end (top in FIG. 3) of the slat 10, and the hook part 13 is curved with a predetermined curvature radius. The hook part 13 includes an inner surface 13*a* and an outer surface 13*b*.

As illustrated in FIG. 3, an accommodation groove part 14 is formed at the other end (bottom in FIG. 3) of the slat 10 and is curved with a predetermined curvature radius. The accommodation groove part 14 includes a first inner surface 14*a*, a second inner surface 14*b* a closed surface 14*c*, and an opening 14*d*. The second inner surface 14*b* of the accommodation groove part 14 has a radius larger than the first inner surface 14*a*. The first inner surface 14*a* extends in a circumferential direction for thereby forming a cylindrical part 15.

The hook part 13 of the slat 10 of one side is pivotally connected to the accommodation groove part 14 of the neighboring slat 10 of the other side. As illustrated in FIG. 4, the hook part 13 of the slat 10 of the lower side is accommodated, in a movable way in the circumferential direction, in the accommodation groove part 14 of the neighboring slat 10 of the upper side. Since the hook part 13 of the slat 10 of the lower side moves in the circumferential direction in the accommodation groove part 14 of the neighboring slat 10 of the upper side, the hook part 13 of the slat 10 of the lower side pivots in the accommodation groove part 14 of the slat 1 of the upper side.

In particular, the inner surface 13*a* of the hook part 13 and the first inner surface 14*a* (namely, the outer surface of the cylindrical part 13) of the accommodation groove part 14 are formed and have the same or similar radiuses, and the outer surface 13*b* of the hook part 13 and the second inner surface 14*b* of the accommodation groove part 14 are formed and have same or similar radiuses. As illustrated in FIG. 4, the hook part 13 of the slat 10 of the lower side can smoothly pivot while maintaining the airtight sealing in the accommodation groove part 14 of the slat 10 of the upper side. In addition, since the hook part 13 pivots like it smoothly slides without using lubricant, noise does not occur, so silent opening and closing may be easily performed.

Meanwhile, at each portion where the hook part 13 and the accommodation groove part 14 come into contact with each other, buffer materials 13*e* and 14*e* are installed. When the slat 10 of the lower side and the slat 10 of the upper side are connected and pivot, it is possible to buffer the impacts when the hook part 13 and the accommodation groove part 14 contact with each other. Preferably, the buffer material 13*e* is installed at the inner surface 13*a* and the end 13*c* of the hook part 13, and the buffer material 14*e* is installed at the closed surface 14*c* of the accommodation groove part 14.

A hollow part 15*a* with a circular cross section is formed at the inner side of the cylindrical part 15, and the hollow part 15*a* is formed at a position eccentric from the center of the cylindrical part 15. With the aid of the thusly eccentric hollow part 15*a*, the cylindrical part 15 has thicknesses "t1" and "t2" which are not uniform in the circumferential direction. Preferably, the cylindrical part 15 has a thickness "t1" which gradually becomes thicker toward the closed surface 14*c* of the accommodation groove part 14 and a thickness "t2" which gradually becomes thinner toward the opening 14*d* of the accommodation groove part 14 (t1>t2). Since the hook part 13 of the slat 10 of the lower side pivots in the accommodation groove part 14 of the slat 10 of the upper side, a resisting performance with respect to the impact when the end 13*c* of the hook part 13 comes into contact with the closed surface 14*c* of the accommodation groove part 14 may be enhanced while preventing the noises due to the impacts.

In addition, the reinforcing rib 10*a* protrudes from a portion in proximity to the opening 14*d* of the accommodation groove part 14 of the slat 10, and the reinforcing rib 10*a* serves to effectively absorb the wind pressure or external impacts while preventing the sagging or bending of the whole structure of the shutter.

A heating member (not illustrated) like a heating wire, etc. may be inserted in the hollow part 15*a* of the cylindrical part 15, so it is possible to prevent the cylindrical part 15 from being frozen and broken because the heating member (not illustrated) generates heat when the temperature suddenly drops or in the winter season.

Figure 5:
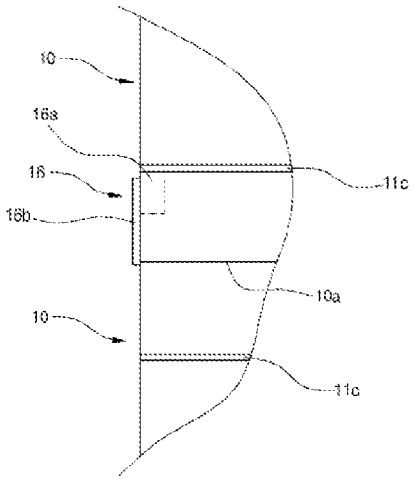
FIG. 5 is a view when viewing from the direction of the arrow indication "C" in FIG. 4.
Figure 6:
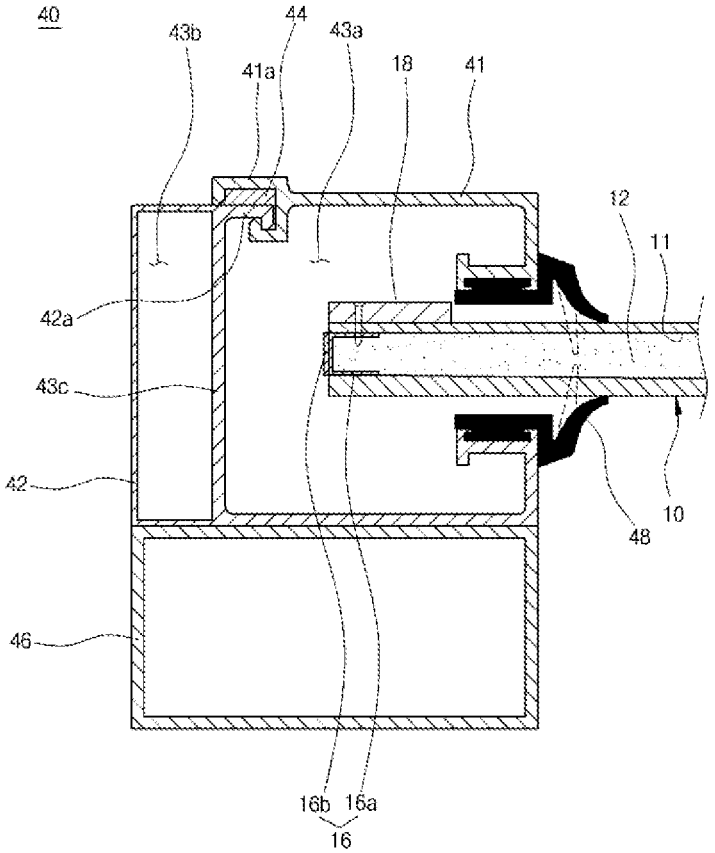
FIG. 6 is a cross sectional view taken along the line D-D of FIG. 2.

As illustrated in FIGS. 4 to 6, the separation prevention member 16 is installed between the slats 10 which are connected in upward and downward directions, and the separation prevention member 16 is engaged through an engaging member, etc. to one slat between the slat 10 of one side and the slat 10 of the other side which are proximately arranged in the upper and lower sides. Here, the separation prevention member 16 includes an engaging part 16*a* inserted in and engaged to the slat 10 of one side, and a hooking part 16*b* which extends from the engaging part 16*a* to the slat 10 of the other side. As illustrated in FIGS. 4 to 6, since the engaging part 16*b* of the separation prevention member 16 is hooked by the neighboring slat 10, it is possible to prevent any separation between the connected slats 10.

As described above, the present invention as a whole has flexibility with the aid of the structure wherein a plurality of the flats 10 are pivotally connected, so it is possible to greatly reduce the winding diameter when the slats are wound by the winding unit 20, and the whole length of the shutter may be extended. Since each slat 10 has a hollow part 11, the slat 10 becomes lighter, so the pulling force may be greatly reduced for thereby saving the consumption of electric power.

The shutter box 30 is installed at the top of the door frame of the building, and in the shutter box 30, the winding unit 20 is installed for winding or unwinding the slats 10.

The winding unit 20 includes at least one first winder member 21 and at least one second winder member 22 which are symmetrically arranged at left and right sides, a first rotary shaft 23 which protrudes from an outer side of the first winder member 21, a second rotary shaft 24 which protrudes from an outer side of the second winder member 22, a plurality of horizontal support members 25 connected crossing the first winder member 21 and the second winder member 22, and a driving motor 26 which is connected through a coupler 27 to one rotary shaft between the first and second rotary shafts 23 and 24.

As illustrated in FIG. 1, the first winder member 21 may be provided by two in number at the left side of the horizontal support member 25, and the second winder member 22 may be provided by two in number at the right side of the horizontal support member 25.

Figure 7:
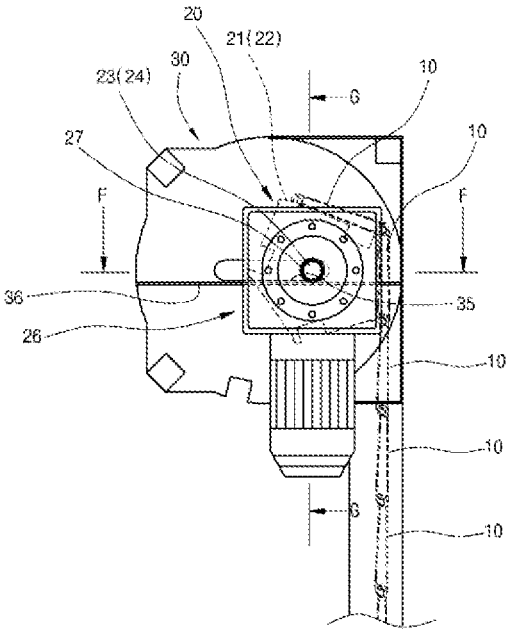
FIG. 7 is an enlarged view of the portion of the arrow indication "E" in FIG. 2.
Figure 8:
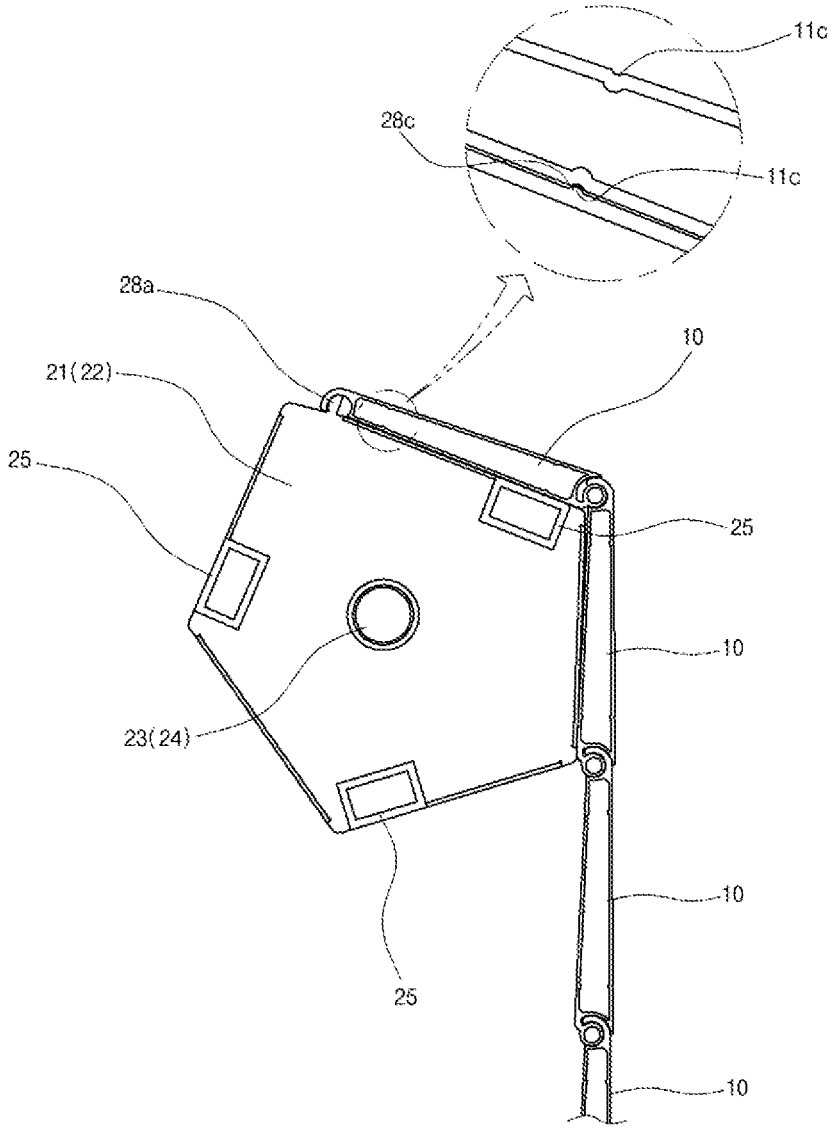
FIG. 8 is a view illustrating an engaged relationship of the winding unit and the slat in FIG. 7.

As illustrated in FIGS. 7 and 8, each of the first winder member 21 and the second winder member 22 may be formed in polygonal shapes like a pentagonal shape, and at one side surface each of them, there is formed an insertion protrusion 28*a* into which the hook part 13 of the slat 10 of the upper most side is pivotally inserted.

The first and second rotary shafts 23 and 24 symmetrically protrude outward from the first and second winder members 21 and 22, respectively, and as illustrated in FIG. 1, the first and second rotary shafts 23 and 24 are rotatably supported in the shutter box 30.

Figure 10:
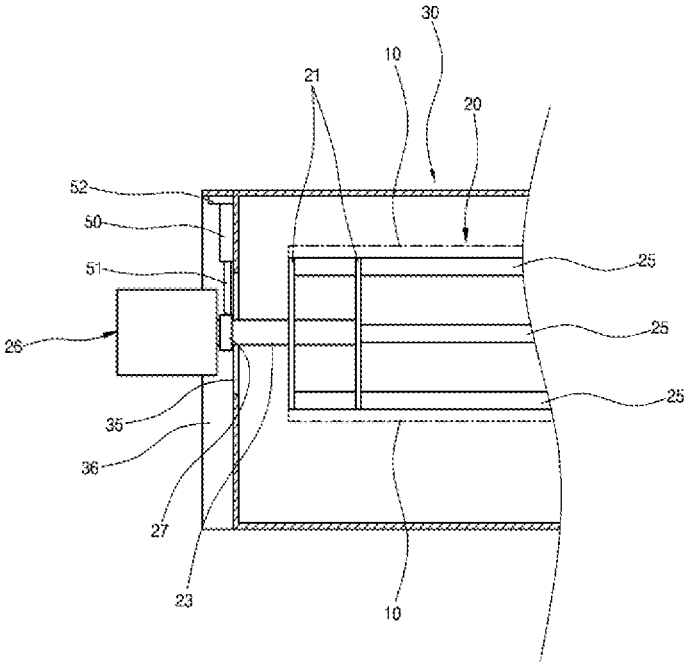
FIG. 10 is a partial cross sectional view taken along the line F-F of FIG. 7.
Figure 11:
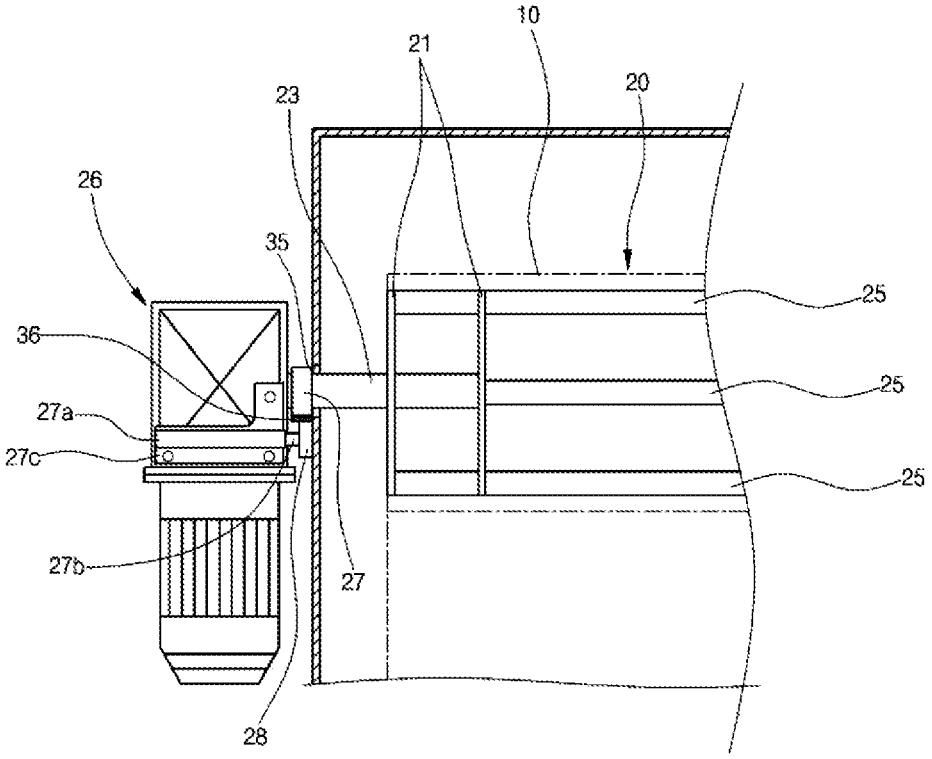
FIG. 11 is a partial cross sectional view taken along the line G-G of FIG. 7.

As illustrated in FIGS. 7 and 10, a slot 35 is horizontally formed at one side wall of the shutter box 30 being in proximity to the driving motor 26. The output shaft of the driving motor 26 passes through the slot 35 and is connected through the coupler 27 to one rotary shaft between the first and second rotary shafts 23 and 24. Referring to FIGS. 1 and 10, the output shaft of the driving motor 26 is connected through the coupler 27 to the first rotary shaft 23.

When the driving motor 26 is driven, the rotational force is transferred to the first and second rotary shafts 23 and 24 of the winding unit 20, and as the first and second winder members 21 and 22 rotate, a plurality of the slats 10 are wound on and unwound from the first and second winder members 21 and 22, respectively.

A shock absorber 50 is installed in proximity to the slot 35 of the shutter box 30, and the shock absorber 50 is fixed at the side wall of the shutter box 30 through an engaging member 52, and a piston rod 51 of the shock absorber 50 buffers and supports the coupler 27. The shock absorber 50 is characterized in that a slot 35 is formed at an outer side surface of the shutter box 30 in order for the first and second rotary shafts 23 and 24 to move in the horizontal direction so as to buffer when the vibrations and impacts occur by means of an angular speed and a tensile compression force between the contacting portion and the non-contacting portion of the first and second winder members 21 and 22 while the slats 10 are wound on or unwound from the first and second winder members 21 and 22 of the winding unit 20, while removing noises. To the bottom of the slot 35, a guide rail 36 is attached for thereby allowing the coupler 27 connected to the first and second rotary shafts 23 and 24 to be slidably supported against the surface of the top thereof, and a fixture 52 is installed at one side of the guide rail 36 so as to reliably fix the shock absorber 50, so the horizontal movements of the first and second rotary shafts 23 and 24 are controlled. In addition, when the driving force of the driving motor 26 is transferred to the first and second rotary shafts 23 and 24, the coupler 27 may naturally move in the horizontal direction of the slot 35 by means of the buffering operation of the shock absorber 50, thus effectively preventing noises.

A bracket 27*c* attached to a decelerator connected to a side surface of the driving motor 26 is fixed, and a support member 27*a* is installed at the bracket 27*c*. A support roller 28 is installed at an end of the support member 27*a* through the rotary shaft 27*b*. Since the support roller 28 moves along the lower surface of the guide rail 36, the first and second rotary shafts 23 and 24 and the driving motor 26 operate in a balanced state.

It is preferred that the driving motor 26 is fixed at one side of the shutter box 30, and it is also preferred that the driving motor 26 is installed at left and right sides so as to enhance tensional force.

As illustrated in FIG. 8, at least one hooking protrusion 28*c* is formed at a side surface of each of the first winder member 21 and the second winder member 22, and at least one hooking groove 11*c* is formed at a side surface of the slat 10. When the slats 10 are wound on the first and second winder members 21 and 22, the groove portion 11*c* of the slat 10 is hooked by the hooking protrusion 28*c* of each of the first and second winder members 21 and 22, so the plurality of the slats 10 may be precisely mounted at the first and second winder members 21 and 22 and may be sequentially wound.

Figure 9:
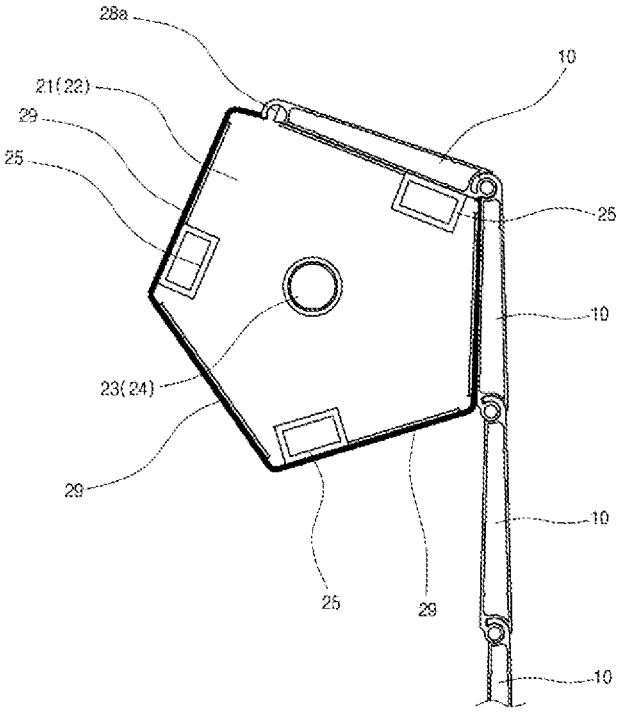
FIG. 9 is a view illustrating a modified embodiment of FIG. 7.

According to an alternative embodiment, as illustrated in FIG. 9, a buffer material 29 is attached to a partial side surface of each of the first and second winder members 21 and 22, and with the aid of the buffer material 29, the plurality of the slats 10 may be wound on the first and second winder members 21 and 22 while buffering, so it is possible to effectively prevent any noises and damages while the slats 10 are being wound. In addition, the hooking protrusion 28*c* in FIG. 8 may be formed on the surface of the buffer material 29. The hooking protrusion 28*c* may be hooked by the groove part 11*c* of the slat 10 and may be mounted therein.

Meanwhile, a pair of guide frames 40 extending in upward and downward directions are disposed at the lower left and right sides of the shutter box 30, and the edges of the left and right sides of each of the slats 10 are guided along the guide frame 40 and are supported.

As illustrated in FIG. 6, the guide frame 40 is formed in an angular structure, and an opening is formed at one side thereof, and a seal member 48 is disposed at the side of the opening. Wind or wind pressure inputted or outputted through the gap of the guide frame 40 may be reduced by means of the seal member 48, thus reinforcing the strength of the structure, and the seal member 48 comes into close contact with the portion contacting with the slat 10, thus increasing the heat efficiency by obtaining a sealing performance, and other impurities are prevented from entering through the gap thus maintaining cleanness. While the opening and closing are performed by moving up or down the slat 10, it is possible to prevent any friction and noises generating due to the contacting movement surfaces.

The hollow parts 43*a* and 43*b* are formed inside of the guide frame 40, and the hollow parts 43*a* and 43*b* are partitioned by a reinforcing partition wall 43*c* into a guide hollow part 43*a* and a reinforcing hollow part 43*b*, so the strength may be reinforced, and an edge of the slat 10 is inserted in the guide hollow part 43*a* and is guided. In particular, a protection member 18 is secured by an engaging member to the edge of the slat 10 inserted in the guide hollow part 43*a* for thereby protecting the edge of the slat 10.

In addition, the present invention has advantages wherein since the filler is filled in the reinforcing hollow part 43*b*, the heat insulation, cold reserving and fireproof, etc. may be maintained while effectively preventing noises.

The guide frame 40 includes a first frame 41 and a second frame 42. A first engaging and attaching part 41*a* is formed at one side of the first frame 41, and a second engaging and attaching part 42*a* is formed at one side of the second frame 42. The first and second engaging and attaching parts 41*a* and 42*a* each are connected through a hook structure, and a key 44 is inserted between the first engaging and attaching part 41*a* and the second engaging and attaching part 42*a*, so the first and second frames 41 and 42 may be reliably engaged.

Meanwhile, a reinforcing frame 46 is engaged to one side of the guide frame 40, so the strength of the guide frame 40 may be further reinforced.

In addition, a photo sensor (not illustrated) may be installed at one side of either the slat 10 or the windproof material 16, whereby it is possible to quickly open the shutter when a predetermined thing is caught in or pedestrian is detected.

Furthermore, an air curtain (not illustrated) may be installed at the shutter box 30 so as to blow air downward, so the air curtain may effectively prevent any inputs of dusts, etc. which are formed when the plurality of the slats 10 move upward or downward.

What is claimed is:

1. A roller shutter, comprising:

a plurality of slats which are continuously connected in upward and downward directions;

a winding unit which is configured to wind or unwind the plurality of the slats in upward and downward directions;

a shutter box which is disposed at the top of a door frame of a building; and a guide frame which is configured to guide the edges of the plurality of the slat, wherein the winding unit is installed inside of the shutter box, and the plurality of the slats are pivotally connected in upward and downward directions, and a hook part is formed at an end of each slat, and the hook part is curved with a predetermined curvature radius, and an accommodation groove part is curved with a predetermined curvature radius at the other end of each slat, and the hook part of the slat of one side is movably accommodated in a circumferential direction in the accommodation groove part of the slat of the other side which is adjacent to the hook part of the slat of one side, and the slat of one side and the slat of the other side which are neighboring in the upward and downward directions perform a relative pivoting operation, and the hook part includes an inner surface and an outer surface, and the accommodation groove part includes a first inner surface, a second inner surface, a closed surface and an opening, and the second inner surface of the accommodation groove part has a radius larger than the first inner surface, and the first inner surface extends in a circumferential direction to form a cylindrical part, and the inner surface of the hook part and the first inner surface of the accommodation groove part have same radiuses, and the outer surface of the accommodation groove part and the second inner surface of the accommodation groove part have same radiuses, and a hollow part having a circular cross section is formed inside of the cylindrical part, and the hollow part is formed at a portion eccentric from the center of the cylindrical part, so the cylindrical part has a thickness which is not uniform in a circumferential direction.

2. The roller shutter of claim 1, wherein a buffer material is disposed at each portion where the hook part and the accommodation groove part come into contact with each other.

3. The roller shutter of claim 2, wherein the buffer material is installed at an inner surface and an end of the hook part, and the buffer material is installed at a closed surface of the accommodation groove part.

4. The roller shutter of claim 1, wherein the cylindrical part has a thickness which gradually becomes thicker toward the closed surface of the accommodation groove part and has a thickness which gradually becomes thinner toward the opening of the accommodation groove part.

5. The roller shutter of claim 1, wherein a reinforcing rib protrudes from a portion in proximity to the opening of the accommodation groove part of the slat.

6. The roller shutter of claim 4, wherein a heating member is inserted in the hollow part of the cylindrical part.

7. The roller shutter of claim 1, wherein a separation prevention member is installed between the slats which are connected in upward and downward directions, and the separation prevention member is secured to one slat between the slat of one side and the slat of the other side which are in proximity to each other in the upward and downward directions, and the separation prevention member comprises an engaging part which is inserted in and engaged to the slat of one side, and a hook part which extends from the engaging part to the slat of the other side.

8. The roller shutter of claim 1, wherein the winding unit comprises:

at least one first winder member and at least one second winder member which are symmetrically disposed at left and right sides;

a first rotary shaft which protrudes from an outer side of the first winder member;

a second rotary shaft which protrudes from an outer side of the second winder member;

a plurality of horizontal support members which are connected crossing the first winder member and the second winder member; and a driving motor which is connected through a coupler to at least one rotary shaft between the first and second rotary shafts, wherein each of the first winder member and the second winder member is formed in a polygonal structure, and at a side surface of each of the first winder member and the second winder member, an insertion protrusion into which the hook part of the slat of the upper most side is pivotally inserted is formed, and the first and second rotary shafts are rotatably supported in the shutter box.

9. The roller shutter of claim 8, wherein a slot is horizontally formed at one side wall of the shutter box which is neighboring with the driving motor, and an output shaft of the driving motor passes through the slot and is connected through the coupler to one rotary shaft between the first and second rotary shafts, and a shock absorber is installed in proximity to the slot of the shutter box, and a piston rod of the shock absorber buffers and supports the bottom of the coupler.

10. The roller shutter of claim 8, wherein a support member is installed at a bracket which is attached to a decelerator drivingly connected to the driving motor, and a rotary shaft is installed at one side, and a support roller is installed at the top thereof, and the first and second rotary shafts and a driving device are balanced based on the movement along the lower surface of the guide rail.

11. The roller shutter of claim 8, wherein at least one hook protrusion is formed at a side surface of each of the first winder member and the second winder member, and at least one hook groove is formed at a side surface of each of the slats, and in case that the slats are wound on the first and second winder members, the groove part of the slat is hooked by the hook protrusion of each of the first and second winder members, so the plurality of the slats are precisely mounted at the first and second winder members.

12. The roller shutter of claim 8, wherein a buffer material is attached to a part of a side surface of each of the first and second winder members.

13. The roller shutter of claim 1, wherein a pair of guide frames extending in upward and downward directions are disposed at lower left and right sides of the shutter box, and the left and right edges of the slats are guided and supported in upward and downward directions by the guide frames, and an opening is formed at one side of the guide frame, and a seal member is disposed at the opening, and a hollow part is formed in the guide frame, and the hollow part is partitioned by a reinforcing partition wall into a guide hollow part and a reinforcing hollow part, and an edge of each of the slats is inserted and guided in the guide hollow part, and a protection member is secured to the edge of the slat inserted in the guide hollow part.

14. The roller shutter of claim 13, wherein the guide frame includes a first frame and a second frame, and a first engaging and attaching part is formed at one side of the first frame, and a second engaging and attaching part is formed at one side of the second frame, and the first and second engaging and attaching parts each are engaged through a hook structure, and a key is inserted between the first engaging and attaching part and the second engaging and attaching part.

15. The roller shutter of claim 1, wherein a hollow part is formed inside of the slat, and a filler such as a heat insulation material, a soundproof material, an incombustible material, etc. is filled in the hollow part for thereby reinforcing heat insulation, cold reserving, fireproof, soundproof functions.

* * * * *